US010975459B2

(12) United States Patent
Nakamura et al.

(10) Patent No.: US 10,975,459 B2
(45) Date of Patent: Apr. 13, 2021

(54) FERRITIC STAINLESS STEEL

(71) Applicant: JFE STEEL CORPORATION, Tokyo (JP)

(72) Inventors: Tetsuyuki Nakamura, Tokyo (JP); Shin Ishikawa, Tokyo (JP); Chikara Kami, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 276 days.

(21) Appl. No.: 15/764,013

(22) PCT Filed: Sep. 20, 2016

(86) PCT No.: PCT/JP2016/004278

§ 371 (c)(1),
(2) Date: Mar. 28, 2018

(87) PCT Pub. No.: WO2017/056452

PCT Pub. Date: Apr. 6, 2017

(65) Prior Publication Data

US 2018/0305797 A1 Oct. 25, 2018

(30) Foreign Application Priority Data

Sep. 29, 2015 (JP) ..... JP2015-190532

(51) Int. Cl.
*C22C 38/54* (2006.01)
*C21D 9/46* (2006.01)
(Continued)

(52) U.S. Cl.
CPC ..... *C22C 38/54* (2013.01); *C21D 6/004* (2013.01); *C21D 6/005* (2013.01); *C21D 6/008* (2013.01);
(Continued)

(58) Field of Classification Search
CPC ..... C22C 38/54
(Continued)

(56) References Cited

U.S. PATENT DOCUMENTS 7,806,993 B2 * 10/2010 Miyazaki ..... C21D 6/002 148/325
8,980,018 B2 3/2015 Hamada et al.
(Continued)

FOREIGN PATENT DOCUMENTS

CN 101437974 A 5/2009
CN 102131946 A 7/2011
(Continued)

OTHER PUBLICATIONS

Chinese Office Action for Chinese Application No. 201680056228.X, dated Jan. 30, 2019 with Concise Statement Relevance of Office Action, 9 pages.
(Continued)

*Primary Examiner* — Coris Fung
*Assistant Examiner* — Danielle M. Carda
(74) *Attorney, Agent, or Firm* — RatnerPrestia

(57) ABSTRACT

Provided is a ferritic stainless steel excellent in oxidation resistance and thermal fatigue resistance. The ferritic stainless steel contains, in mass %, C: 0.020% or less, Si: more than 0.1% and 3.0% or less, Mn: 0.05 to 2.0%, P: 0.050% or less, S: 0.010% or less, Al: 0.3 to 6.0%, N: 0.020% or less, Cr: 12 to 30%, Nb: more than 0.3% and 1.0% or less, Ti: 0.01 to 0.5%, Mo: 0.3 to 6.0%, Co: 0.01 to 3.0%, and Ni: 0.02 to 1.0%, the balance being Fe and unavoidable impurities. Moreover, Si+Al>1.0%, Al—Mn>0%, and Nb—Ti>0% hold.

1 Claim, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 6/00*** | (2006.01) |
| ***C22C 38/58*** | (2006.01) |
| ***C22C 38/34*** | (2006.01) |
| ***C22C 38/42*** | (2006.01) |

(52) U.S. Cl.
CPC ..... *C21D 8/0205* (2013.01); *C21D 8/0226* (2013.01); *C21D 8/0236* (2013.01); *C21D 8/0263* (2013.01); *C21D 9/46* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/58* (2013.01); *C21D 8/0273* (2013.01); *C21D 2211/005* (2013.01)

(58) Field of Classification Search
USPC ..... 420/38
See application file for complete search history.

(56) References Cited

U.S. PATENT DOCUMENTS

| | | | | |
|---|---|---|---|---|
| 9,487,849 | B2 | 11/2016 | Ishii et al. | |
| 9,873,924 | B2 | 1/2018 | Santacreu et al. | |
| 2002/0036036 | A1 | 3/2002 | Muraki et al. | |
| 2010/0150770 | A1 | 6/2010 | Hiraide et al. | |
| 2014/0023550 | A1 | 1/2014 | Hamada et al. | |
| 2014/0308154 | A1* | 10/2014 | Ishii | C22C 38/001 420/38 |
| 2015/0218683 | A1 | 8/2015 | Nakamura et al. | |
| 2016/0115562 | A1 | 4/2016 | Santacreu et al. | |

FOREIGN PATENT DOCUMENTS

| | | | |
|---|---|---|---|
| CN | 103958717 | A | 7/2014 |
| CN | 104093872 | A | 10/2014 |
| CN | 104903482 | A | 9/2015 |
| EP | 1170392 | A1 | 1/2002 |
| EP | 2351868 | A1 | 8/2011 |
| EP | 2677055 | A1 | 12/2013 |
| EP | 2695962 | A1 | 2/2014 |
| EP | 2787097 | A1 | 10/2014 |
| EP | 2811044 | A1 | 12/2014 |
| JP | H0472040 | A | 3/1992 |
| JP | 2001303204 | A | 10/2001 |
| JP | 2001316773 | A | 11/2001 |
| JP | 2004018921 | A | 1/2004 |
| JP | 2005187857 | A | 7/2005 |
| JP | 2008285693 | A | 11/2008 |
| JP | 2009068113 | A | 4/2009 |
| JP | 2009215648 | A | 9/2009 |
| JP | 2010156039 | A | 7/2010 |
| JP | 2011162863 | A | 8/2011 |
| JP | 2011190468 | A | 9/2011 |
| JP | 2011202257 | A | 10/2011 |
| JP | 2012117084 | A | 6/2012 |
| JP | 2012193435 | A | 10/2012 |
| JP | 2012207252 | A | 10/2012 |
| JP | 2014214321 | A1 | 11/2014 |
| JP | 2015096648 | * | 5/2015 |
| JP | 2015096648 | A1 | 5/2015 |
| TW | 201237188 | A | 9/2012 |
| WO | 2014033372 | A1 | 3/2014 |
| WO | 2014050016 | A1 | 4/2014 |

OTHER PUBLICATIONS

Chinese Office Action for Chinese Application NO. 201680056228.X, dated Aug. 16, 2019, with Concise Statement of Relevance of Office Action, 5 pages.

Taiwan Office Action for Taiwan Application No. 105131299, dated Jul. 11, 2017, with Concise Statement of Relevance of Office Action, 5 pages.

Extended European Search Report for European Application No. 16 850 632.7, dated May 2, 2018, 9 pages.

International Search Report and Written Opinion for International Application No. PCT/JP2016/004278, dated Dec. 13, 2016, 4 pages.

Korean Office Action for Korean Application No. 10-2018-7008622, dated Jun. 7, 2019, with Concise Statement of Relevance of Office Action, 5 pages.

* cited by examiner

FERRITIC STAINLESS STEEL

CROSS REFERENCE TO RELATED APPLICATIONS

This is the U.S. National Phase application of PCT/JP2016/004278, filed Sep. 20, 2016, which claims priority to Japanese Patent Application No. 2015-190532, filed Sep. 29, 2015, the disclosures of these applications being incorporated herein by reference in their entireties for all purposes.

TECHNICAL FIELD OF THE INVENTION

The present invention relates to a Cr-containing steel and particularly to a ferritic stainless steel having excellent oxidation resistance and excellent thermal fatigue resistance and suitably used for exhaust components which are used at high temperature such as exhaust pipes and converter cases of automobiles and motorcycles and exhaust ducts of thermal power plants.

BACKGROUND OF THE INVENTION

Exhaust components of automobiles such as exhaust manifolds, exhaust pipes, converter cases, and mufflers are required to have excellent oxidation resistance and excellent thermal fatigue resistance. Thermal fatigue is a low-cycle fatigue phenomenon which occurs in an exhaust component of an engine when the engine is repeatedly started and stopped and so the exhaust component is repeatedly heated and cooled. Since the exhaust component is restrained by its surrounding components, the thermal expansion and contraction of the exhaust component are restricted, and the thermal strain generated in the material of the exhaust component causes thermal fatigue.

At present, Cr-containing steels such as Type 429 steel containing Nb and Si (14% Cr-0.9% Si-0.4% Nb) are often used as materials for the components required to have oxidation resistance and thermal fatigue resistance. As engine performance is improved, the temperature of exhaust gas increases. If the exhaust gas temperature exceeds 900° C., the Type 429 steel cannot satisfy the required thermal fatigue resistance sufficiently.

Materials capable of addressing this problem have been developed, such as Cr-containing steels having improved high-temperature proof stress obtained by containing Nb and Mo, SUS444 (19% Cr-0.4% Nb-2% Mo) specified in JIS G4305, and ferritic stainless steels containing Nb, Mo, and W (see, for example, Patent Literature 1). However, to address the recent tightening of exhaust gas regulations and to improve fuel consumption, the exhaust gas temperature tends to increase. Therefore, the heat resistance may be insufficient even using SUS444 etc., and there is a need to develop materials having higher heat resistance than SUS444.

Examples of the materials having higher heat resistance than SUS444 include materials disclosed in Patent Literature 2 to Patent Literature 8. These materials are prepared by containing Cu to SUS444, and their thermal fatigue resistance are improved by precipitation strengthening of Cu.

A technique for improving heat resistance by positively containing Al has been proposed. For example, Patent Literature 9 to Patent Literature 13 disclose ferritic stainless steels having improved high-temperature strength and oxidation resistance obtained by containing Al.

Patent Literature 14 and Patent Literature 15 disclose ferritic stainless steels having improved oxidation resistance and thermal fatigue resistance obtained by containing Al and Co and optionally containing Cu.

Patent Literature 16 and Patent Literature 17 disclose steels having improved heat resistance obtained by containing Al.

CITATION LIST

Patent Literature

PTL 1: Japanese Unexamined Patent Application Publication No. 2004-018921

PTL 2: Japanese Unexamined Patent Application Publication No. 2010-156039

PTL 3: Japanese Unexamined Patent Application Publication No. 2001-303204

PTL 4: Japanese Unexamined Patent Application Publication No. 2009-215648

PTL 5: Japanese Unexamined Patent Application Publication No. 2011-190468

PTL 6: Japanese Unexamined Patent Application Publication No. 2012-117084

PTL 7: Japanese Unexamined Patent Application Publication No. 2012-193435

PTL 8: Japanese Unexamined Patent Application Publication No. 2012-207252

PTL 9: Japanese Unexamined Patent Application Publication No. 2008-285693

PTL 10: Japanese Unexamined Patent Application Publication No. 2001-316773

PTL 11: Japanese Unexamined Patent Application Publication No. 2005-187857

PTL 12: Japanese Unexamined Patent Application Publication No. 2009-68113

PTL 13: Japanese Unexamined Patent Application Publication No. 2011-162863

PTL 14: Japanese. Unexamined Patent Application Publication No. 2015-96648

PTL 15: Japanese Unexamined Patent Application Publication No. 2014-214321

PTL 16: WO2014/050016

PTL 17: Japanese Unexamined Patent Application Publication No. 2011-202257

SUMMARY OF THE INVENTION

According to the studies by the present inventors, with the Mo-containing steels disclosed in Patent Literature 2 to Patent Literature 8, although the thermal fatigue resistance is improved, the oxidation resistance of the steels is insufficient. Therefore, there is a room for improvement in the effect of improving thermal fatigue resistance when the exhaust gas temperature is higher. Another problem with the Mo-containing steels is that, when they are subjected to a thermal fatigue test at 850° C. or higher, a coarse second phase (σ phase) containing Mo and Cr precipitates, which causes a deterioration, instead of an increase, in thermal fatigue life.

The Al-containing steels disclosed in Patent Literature 9 to Patent Literature 13 have high high-temperature strength and excellent oxidation resistance. However, a problem with these steels is that, since their thermal expansion coefficient is large, thermal fatigue resistance under repeated heating and cooling is insufficient.

Patent Literature 14 and Patent Literature 15 disclose the steels having improved oxidation resistance and thermal fatigue resistance obtained by containing Al and Co and optionally containing Cu. However, the effect of improving the thermal fatigue resistance is not sufficient, and there is a room for improvement.

Patent Literature 16 and Patent Literature 17 disclose the steels having improved heat resistance obtained by containing Al. However, their high-temperature strength is insufficient, and the thermal fatigue resistance when the exhaust gas temperature is high are insufficient.

As described above, with the conventional techniques, a ferritic stainless steel having both sufficient oxidation resistance and sufficient thermal fatigue resistance even when the exhaust gas temperature is higher cannot be obtained.

It is therefore an object of aspects of the present invention to solve the above problems and provide a ferritic stainless steel excellent in oxidation resistance and thermal fatigue resistance.

The phrase "excellent in oxidation resistance" in accordance with aspects of the present invention means that the steel has both continuous oxidation resistance and cyclic oxidation resistance. The continuous oxidation resistance means that, even when the steel is held in air at 1,100° C. for 200 hours, no breakaway oxidation (weight gain by oxidation 50 g/m$^2$) and no spalling of oxide scale occur. The cyclic oxidation resistance means that, when the steel is subjected to 400 heating and cooling cycles between temperatures of 1,100° C. and 200° C. in air, no breakaway oxidation and no spalling of oxide scale occur.

The phrase "excellent in thermal fatigue resistance" means that the steel has better resistance than SUS444 and specifically means that the thermal fatigue life of the steel when it is repeatedly heated and cooled between 200 to 950° C. is longer than that of SUS444.

To develop a ferritic stainless steel having better oxidation resistance and thermal fatigue resistance than SUS444, the present inventors have conducted extensive studies on the influence of various elements on the oxidation resistance and thermal fatigue resistance.

The inventors have found that, in a steel containing, in mass %, Nb in an amount of more than 0.3% and 1.0% or less and Mo in an amount within the range of 0.3 to 6.0%, the high-temperature strength of the steel is higher over a wide temperature range and its thermal fatigue resistance is improved. The inventors have also found that the thermal fatigue resistance is influenced by oxidation resistance and creep resistance. The inventors have also found that, when the steel contains Al in an amount within the range of 0.3 to 6.0% by mass, the creep resistance, particularly in a high temperature range, is improved and the thermal fatigue resistance is thereby improved significantly.

The inventors, have also found that the increase in thermal expansion coefficient can be prevented when an appropriate amount of Co is contained and that precipitation of the second phase (σ phase) can be prevented when Al is contained.

Aspects of the present invention have been completed on the basis of the above findings and provides a steel containing all of Cr, Nb, Mo, Al, Co, Si, Mn, and Ti in appropriate amounts. If the amount of even one of these elements contained is not appropriate, excellent oxidation resistance and excellent thermal fatigue resistance, which are desired in accordance with aspects of the present invention, are not obtained.

Aspects of the present invention are summarized as follows:

[1] A ferritic stainless steel having a composition comprising, in mass %, C: 0.020% or less, Si: more than 0.1% and 3.0% or less, Mn: 0.05 to 2.0%, P: 0.050% or less, S: 0.010% or less, Al: 0.3 to 6.0%, N: 0.020% or less, Cr: 12 to, 30%, Nb: more than 0.3% and 1.0% or less, Ti: 0.01 to 0.5%, Mo: 0.3 to 6.0%, Co: 0.01 to 3.0%, and Ni: 0.02 to 1.0%, the balance being Fe and unavoidable impurities, wherein the ferritic stainless steel satisfies the following formulas (1) to (3):

$$Si+Al>1.0\% \quad (1)$$

$$Al—Mn>0\% \quad (2)$$

$$Nb—Ti>0\% \quad (3)$$

(where Si, Al, Mn, Nb, and Ti in formulas (1) to (3) represent the contents. (in mass %) of the respective elements).

[2] The ferritic stainless steel according to [1], further comprising, in mass %, one or two or more selected from B: 0.0002 to 0.0050%, Zr: 0.005 to 1.0%, V: 0.01 to 1.0%, Cu: 0.01 to 0.30%, and W: 0.01 to 5.0%.

[3] The ferritic stainless steel according to [1] or [2], further comprising, in mass %, one or two selected from Ca: 0.0002 to 0.0050% and Mg: 0.0002 to 0.0050%.

In the present description, % representing each of the components of the steel is % by mass.

According to aspects of the present invention, a ferritic stainless steel having better oxidation resistance and thermal fatigue resistance than SUS444 (JIS G4305) can be provided. Therefore, the steel according to aspects of the present invention can be suitably used for exhaust components of automobiles etc.

DETAILED DESCRIPTION OF EMBODIMENTS OF THE INVENTION

Figure 1:
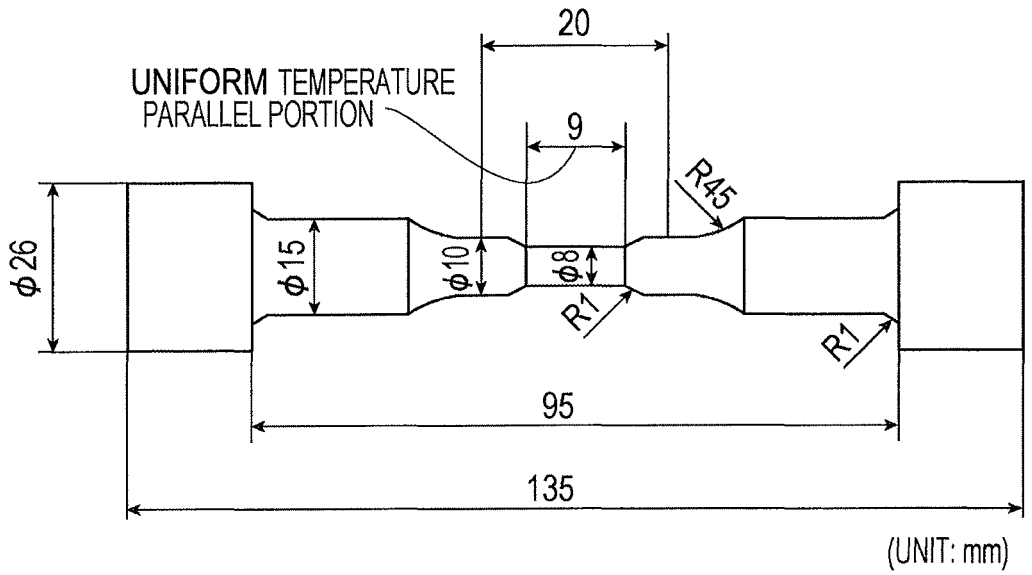
FIG. 1 is an illustration showing a thermal fatigue test piece.

Embodiments of the present invention will next be described in detail.

The ferritic stainless steel according to aspects of the present invention contains, in mass %, C: 0.020% or less, Si: more than 0.1% and 3.0% or less, Mn: 0.05 to 2.0%, P: 0.050% or less, S: 0.010% or less, Al: 0.3 to 6.0%, N: 0.020% or less, Cr: 12 to 30%, Nb: more than 0.3% and 1.0% or less, Ti: 0.01 to 0.5%, Mo: 0.3 to 6.0%, Co: 0.01 to 3.0%, and Ni: 0.02 to 1.0%, the balance being Fe and unavoidable impurities. The ferritic stainless steel satisfies: Si+Al>1.0% (1), Al—Mn>0% (2), and Nb—Ti>0% (3) (Si, Al, Mn, Nb, and Ti in formulas (1) to (3) represent the contents (in mass %) of the respective elements).

In accordance with aspects of the present invention, keeping compositional components in balance is very important. When the above combination of the components is used, a ferritic stainless steel having better oxidation resistance and thermal fatigue resistance than SUS444 can be obtained. If even one of the components is outside its range shown above, the desired oxidation resistance and the desired thermal fatigue resistance are not obtained.

Next, the chemical composition of the ferritic stainless steel according to aspects of the present invention will be described. In the following description, % representing each of the components of the steel is % by mass.

C: 0.020% or less

C is an element effective in strengthening the steel. However, if the content of C exceeds 0.020%, the toughness and formability of the steel is deteriorated significantly. Therefore, the C content is 0.020% or less. In terms of ensuring the formability, the C content is preferably 0.010% or less. The C content is more preferably 0.008% or less. In, terms of ensuring the strength of an exhaust component, the C content is preferably 0.001% or more. The C content is more preferably 0.003% or more.

Si: more than 0.1% and 3.0% or less

Si is an important element necessary to improve the oxidation resistance. To ensure the oxidation resistance in higher-temperature exhaust gas, the content of Si must be more than 0.1%. If the Si content is excessively high, i.e., more than 3.0%, workability at room temperature is deteriorated. Therefore, the upper limit of the Si content is 3.0%. The Si content is preferably more than 0.10%. The Si content is more preferably more than 0.30%. The Si content is still more preferably more than 0.70%. On the other hand, the Si content is preferably 2.00% or less. The Si content is more preferably 1.50% or less.

Mn: 0.05 to 2.0%

Mn has the effect of improving resistance to spalling of oxide scale. To obtain this effect, it is necessary that the content of Mn be 0.05% or more. However, if the Mn content is excessively large, i.e., more than 2.0%, a γ phase is likely to be formed at high temperature, causing deterioration of heat resistance. Therefore, the Mn content is 0.05% or more and 2.0% or less. The Mn content is preferably more than 0.10%. The Mn content is more preferably more than 0.20%. On the other hand, the Mn content is preferably 1.00% or less. The Mn content is more preferably 0.60% or less.

P: 0.050% or less

P is a harmful element that causes deterioration of the toughness of the steel, and it is desirable to reduce the content of P as much as possible. The P content is 0.050% or less. The P content is preferably 0.040% or less. The P content is more preferably 0.030% or less.

S: 0.010% or less

S is a harmful element that reduces the elongation and r value of the stainless steel to adversely affect its formability, and that causes deterioration of corrosion resistance, which is the fundamental property of the stainless steel. It is therefore desirable to reduce the content of S as much as possible. In accordance with aspects of the present invention, the S content is 0.010% or less. The S content is preferably 0.005% or less.

Al: 0.3 to 6.0%

Al is an essential element for preventing high-temperature deformation (creep) and improving the thermal fatigue resistance. As the temperature at which the steel is used increases, the thermal fatigue resistance of the steel is deteriorated due to high-temperature deformation. Therefore, in view of the trend toward increasing exhaust gas temperature, Al is an important element. Moreover, Al has the effect of improving the oxidation resistance of the steel. In steels containing Mo as in embodiments of the present invention, Al also exhibits the effect of preventing precipitation of a second phase (σ phase) containing Mo during a thermal fatigue test. When the second phase precipitates, the amount of solute Mo decreases. In this case, not only the solid solution strengthening effect of Mo described later is not obtained, but also the second phase coarsens in a short time, so cracking may start from the coarse second phase. To obtain these effects, the content of Al must be 0.3% or more. One drawback of Al is that it causes an increase in thermal expansion coefficient. In accordance with aspects of the present invention, an appropriate amount of Co is contained to reduce the thermal expansion coefficient. However, if the Al content exceeds 6.0%, the thermal expansion coefficient increases, and the thermal fatigue resistance is deteriorated. Moreover, the steel is hardened considerably, and the workability is deteriorated. Therefore, the Al content is 0.3 to 6.0%. The Al content is preferably more than 1.00%. The Al content is more preferably more than 1.50%. The Al content is still more preferably more than 2.00%. On the other hand, the Al content is preferably 5.00% or less. The Al content is more preferably 4.00% or less.

N: 0.020% or less

N is an element that causes deterioration of the toughness and formability of the steel. If the content of N exceeds 0.020%, the deterioration of the toughness and formability is significant. Therefore, the N content is 0.020% or less. In terms of ensuring the toughness and formability, it is desirable to reduce the N content as much as possible. The N content is preferably less than 0.010%.

Cr: 12 to 30%

Cr is an important element effective in improving the corrosion resistance and oxidation resistance, which are features of the stainless steel. If the content of Cr is less than 12%, the oxidation resistance obtained is insufficient. If the oxidation resistance is insufficient, a large amount of oxide scale is formed. In this case, the cross-sectional area of the material decreases, so the thermal fatigue resistance is deteriorated. However, Cr is an element that harden the steel and deteriorate its ductility by solid solution strengthening at room temperature. If the Cr content exceeds 30%, the above harmful influence becomes significant. Therefore, the upper limit of the Cr content is 30%. The Cr content is preferably 14.0% or more. The Cr content is more preferably more than 16.0%. The Cr content is still more preferably more than 18.0%. On the other hand, the Cr content is preferably 25.0% or less. The Cr content is more preferably 22.0% or less.

Nb: more than 0.3% and 1.0% or less

Nb is an important element in accordance with aspects of the present invention. Since Nb fixes C and N by forming carbonitride, it has the function of improving the corrosion resistance, the formability, and grain boundary corrosion resistance of a weld zone, and increases high-temperature strength to thereby improve the thermal fatigue resistance. These effects are obtained when the content of Nb is more than 0.3%. If the Nb content is 0.3% or less, the high-temperature strength is insufficient, and excellent thermal fatigue resistance cannot be obtained. If the Nb content is more than 1.0% however, a Laves phase ($Fe_2Nb$), which is an intermetallic compound, and the like are likely to precipitate, and this facilitates embrittlement. Therefore, the Nb content is more than 0.3% and 1.0% or less. The Nb content is preferably 0.35% or more. The Nb content is more preferably more than 0.40%. The Nb content is still more preferably more than 0.50%. On the other hand, the Nb content is preferably less than 0.80%. The Nb content is more preferably less than 0.60%.

Ti: 0.01 to 0.5%

Ti is an element that improves the corrosion resistance and the formability, and prevents grain boundary corrosion of a weld zone by fixing C and N, as is Nb. When Ti is contained, it combines with C and N more preferentially than Nb. Therefore, an effective amount of solute Nb for high-temperature strength can be ensured in the steel, and this is effective in improving the heat resistance. In the steel according to aspects of the present invention that contains Al, Ti is an element effective also in improving the oxidation resistance and is an essential element particularly for a steel used in a high-temperature range and required to have high oxidation resistance. If the oxidation resistance is insufficient, a large amount of oxide scale is formed. In this case, the cross-sectional area of the material decreases, so the thermal fatigue resistance is deteriorated. To obtain oxidation resistance at high temperature, the content of Ti is 0.01% or more. If the Ti content is excessively high, i.e., more than 0.5%, the effect of improving the oxidation resistance is saturated, and the toughness is deteriorated. In this case, for example, the steel may be ruptured by repeated bending-unbending in a hot strip annealing line, and this causes an adverse effect on productivity. Therefore, the upper limit of the Ti content is 0.5%. The Ti content is preferably more than 0.10%. The Ti content is more preferably more than 0.15%. On the other hand, the Ti content is preferably 0.40% or less. The Ti content is more preferably 0.30% or less.

Mo: 0.3 to 6.0%

Mo dissolves in the steel to thereby increase the high-temperature strength of the steel and is therefore an element effective in improving the thermal fatigue resistance. This effect is obtained when the content of Mo is 0.3% or more. If the Mo content is less than 0.3%, the high-temperature strength is insufficient, and excellent thermal fatigue resistance is not obtained. If the Mo content is excessively high, the steel is hardened, and its workability is deteriorated. Moreover, since a coarse intermetallic compound such as the σ phase is easily formed, the thermal fatigue resistance is impaired instead of improved. Therefore, the upper limit of the Mo content is 6.0%. The Mo content is preferably more than 0.50%. The Mo content is more preferably more than 1.2%. The Mo content is still more preferably more than 1.6%. On the other hand, the Mo content is preferably 5.0% or less. The Mo content is more preferably 4.0% or less. The Mo content is still more preferably 3.0% or less.

Co: 0.01 to 3.0%

Co is known as an element effective in improving the toughness of the steel. Besides, in accordance with aspects of the present invention, Cods an important element that reduces the thermal expansion coefficient, which is increased by containing Al. To obtain these effects, the content of Co is 0.01% or more. When the Co content is excessively large, the toughness of the steel is reduced instead of increased, and also the thermal fatigue resistance is deteriorated. Therefore, the upper limit of the Co content is 3.0%. The Co content is preferably 0.01% or more and less than 0.30%. The Co content is more preferably 0.01% or more and less than 0.05%.

Ni: 0.02 to 1.0%

Ni is an element that improves the toughness and oxidation resistance of the steel. To obtain these effects, the content of Ni is 0.02% or more. If the oxidation resistance is insufficient, a large amount of oxide scale is formed. In this case, the cross-sectional area of the material decreases, and spalling of oxide scale occurs, so the thermal fatigue resistance is deteriorated. However, since Ni is a strong γ phase-forming element, the γ phase is formed at high temperature, and the oxidation resistance is deteriorated. Therefore, the upper limit of the Ni content is 1.0%. The Ni content is preferably 0.05% or more. The Ni content is more preferably more than 0.10%. On the other hand, the Ni content is preferably less than 0.80%. The Ni content is more preferably less than 0.50%.

$$Si+Al>1.0\% \quad (1)$$

As described above, Si and Al are elements effective in improving the oxidation resistance. This effect is obtained when the Si content is more than 0.1% and the Al content is 0.3% or more. To obtain oxidation resistance high enough in a trend towards high exhaust gas temperature, the contents of these elements must be within the above prescribed ranges, and at least Si+Al>1.0% must hold. If the oxidation resistance is insufficient, a large amount of oxide scale is formed. In this case, the cross-sectional area of the material decreases, so the thermal fatigue resistance is deteriorated. Preferably, Si+Al>2.0%. More preferably, Si+Al>3.0%.

$$Al—Mn>0\% \quad (2)$$

As described above, Mn has the effect of improving the resistance to spalling of oxide scale. However, if the Mn content is equal to or larger than the Al content, the effect of Al on improvement in oxidation resistance is reduced. Therefore, the Al content is set to be larger than the Mn content (Al>Mn). Specifically, the Al content and the Mn content are set within the above ranges while Al—Mn>0% holds.

$$Nb—Ti>0\% \quad (3)$$

As described above, if the Ti content is excessively large, the toughness is deteriorated. Further, in the case where the contents of Nb and Ti fall within the above-described compositional ranges in the steel according to aspects of the present invention, if the Ti content is equal to or larger than the Nb content, sufficient thermal fatigue resistance is not obtained. Therefore, the Nb content is set to be larger than the Ti content (Nb>Ti). Specifically, the Nb content and the Ti content are set within the above ranges while Nb—Ti>0% holds.

Si, Al, Mn, Nb, and Ti in formulas (1) to (3) above represent the contents (% by mass) of the respective elements.

In the ferritic stainless steel according to aspects of the present invention, the balance is Fe and unavoidable impurities.

The ferritic stainless steel according to aspects of the present invention may contain, in addition to the above essential components, one or two or more selected from B, Zr, V, W, and Cu within the following ranges.

B: 0.0002 to 0.0050%

B is an element effective in improving the workability, particularly secondary workability, of the steel. This effect is obtained when the content of B is 0.0002% or more. When the B content is excessively large, BN is formed, and the workability is deteriorated. Therefore, when B is contained, the B content is 0.0002 to 0.0050%. On the other hand, the B content is preferably 0.0005% or more. The B content is more preferably 0.0008% or more. The B content is preferably 0.0030% or less. The B content is more preferably 0.0020% or less.

Zr: 0.005 to 1.0%

Zr is an element that improves the oxidation resistance. In accordance with aspects of the present invention, Zr may be contained as needed. To obtain this effect, it is preferable that the content of Zr is 0.005% or more. If the Zr content exceeds 1.0%, Zr intermetallic compounds precipitate, and this causes embrittlement of the steel. Therefore, when Zr is contained, the Zr content is 0.005 to 1.0%.

V: 0.01 to 1.0%

V is an element effective in improving the workability of the steel and is also an element effective in improving the oxidation resistance. These effects are significant when the content of V is 0.01% or more. If the V content is excessively large, i.e., more than 1.0%, coarse V(C, N) precipitates are formed. This causes not only a deterioration in toughness but also deterioration of surface property. Therefore, when V is contained, its content is 0.01 to 1.0%. The V content is preferably 0.03% or more. On the other hand, the V content is more preferably 0.05% or more. The V content is preferably 0.50% or less. The V content is more preferably 0.30% or less.

Cu: 0.01 to 0.30%

Cu is an element having the effect of improving the corrosion resistance of the steel and is contained when the corrosion resistance is required. This effect is obtained when the content of Cu is 0.01% or more. If the Cu content exceeds 0.30%, spalling of oxide scale occurs easily, and this causes deterioration in cyclic oxidation resistance. Therefore, when Cu is contained, the Cu content is 0.01 to 0.30%. The Cu content is preferably 0.02% or more. The Cu content is preferably 0.20% or less. The Cu content is more preferably 0.03% or more. The Cu content is more preferably 0.10% or less.

W: 0.01 to 5.0%

W is an element that significantly improves the high-temperature strength through solid solution strengthening, as is Mo. This effect is obtained when the content of W is 0.01% or more. If the W content is excessively large, the steel is hardened considerably. In addition, firm scale is formed in an annealing step during production, and it is difficult to remove the scale by pickling. Therefore, when W is contained, the W content is 0.01 to 5.0%. The W content is preferably 0.30% or more. The W content is more preferably 1.0% or more. On the other hand, the W content is preferably 4.0% or less. The W content is more preferably 3.0% or less.

The ferritic stainless steel according to aspects of the present invention may further contain one or two selected from Ca and Mg within the following ranges.

Ca: 0.0002 to 0.0050%

Ca is a component effective in preventing clogging of a nozzle caused by Ti-based inclusions which is likely to occur during continuous casting. This effect is obtained when the content of Ca is 0.0002% or more. To obtain good surface property without the occurrence of surface defects, the Ca content must be 0.0050% or less. Therefore, when Ca is contained, the Ca content is 0.0002 to 0.0050%. The Ca content is preferably 0.0005% or more. On the other hand, the Ca content is preferably 0.0030% or less. The Ca content is more preferably 0.0020% or less.

Mg: 0.0002 to 0.0050%

Mg is an element effective in increasing the ratio of equiaxed crystals in a slab to thereby improve the workability and toughness. In steels containing Nb and Ti as in embodiments of the present invention, Mg also exhibits the effect of suppressing coarsening of carbonitrides of Nb and Ti. This effect is obtained when the content of Mg is 0.0002% or more. When the carbonitride of Ti is coarsened, brittle cracking starts from the coarsened carbonitride, and this causes a significant deterioration in the toughness of the steel. When the carbonitride of Nb is coarsened, the amount of solute Nb in the steel is, reduced, and this leads to deterioration of the thermal fatigue resistance. If the Mg content exceeds 0.0050%, the surface property of the steel is deteriorated. Therefore, when Mg is contained, the Mg content is 0.0002 to 0.0050%. The Mg content is preferably 0.0002% or more. The Mg content is more preferably 0.0004% or more. On the other hand, the Mg content is preferably 0.0030% or less. The Mg content is more preferably 0.0020% or less.

Next, a method for producing the ferritic stainless steel according to aspects of the present invention will be described.

No particular limitation is imposed on the method for producing the stainless steel according to aspects of the present invention, and any ordinary method for producing ferritic stainless steel may be suitably used. For example, the stainless steel according to aspects of the present invention can be produced through the following process. Molten steel is produced using a known melting furnace such as a converter or an electric furnace and is then optionally subjected to secondary refining such as ladle refining or vacuum refining to thereby obtain a steel having the above-described chemical composition in accordance with aspects of the present invention. Then the steel is formed into a steel block (slab) using a continuous casting method or an ingot casting-cogging method. Then the slab is subjected to, for example, hot rolling, hot strip annealing, pickling, cold rolling, finish annealing, and pickling steps to thereby obtain an annealed cold-rolled sheet. The cold rolling may be performed once or twice or more with process annealing therebetween. The cold rolling, finish annealing, and pickling steps may be repeated. The hot strip annealing may be omitted. When the steel sheet is required to have surface gloss or a controlled roughness, skin pass rolling may be performed after the cold rolling or the finish annealing.

Preferred production conditions in the above production method will be described.

Preferably, in the steelmaking step for producing the molten steel, the molten steel produced in, for example, a convertor or an electric furnace, is subjected to secondary refining by, for example, a VOD method to thereby prepare a steel containing the above-described essential components and optional components. The molten steel produced can be formed into a raw steel using a known method. It is preferable in terms of productivity and quality to use a continuous casting method. The raw steel is then heated to preferably 1,050 to 1,250° C. and hot-rolled into a hot-rolled sheet having a desired thickness. Of course, the raw steel may be hot-worked into a shape other than the sheet shape. If necessary, the hot-rolled sheet is subjected to continuous annealing at a temperature of 900 to 1,150° C. Preferably, the resulting hot-rolled sheet is then subjected to descaling by, for example, pickling to thereby prepare a hot-rolled product. If necessary, the scale may be removed by shot blasting before the pickling.

The annealed hot-rolled sheet may be further subjected to a cold rolling step etc. to obtain a cold-rolled product. In this case, the cold rolling may be performed only once or may be performed twice or more with intermediate annealing therebetween, in terms of productivity and the required quality. The total rolling reduction in the cold rolling performed once or twice or more is preferably 60% or more and more preferably 70% or more. Preferably, the cold-rolled steel sheet is subjected to continuous annealing (finish annealing) at a temperature of preferably 900 to 1,150° C. and more preferably 950 to 1,150° C. and then pickled to thereby obtain a cold-rolled product. For some applications, skin pass rolling etc. may be performed after the finish annealing to control the shape, surface roughness, and quality of the steel sheet.

The hot rolled or cold rolled product obtained in the manner described above is then subjected to cutting, bending, bulging, drawing, etc. according to its intended application and thereby formed into an exhaust pipe of an automobile or a motorcycle, a catalyst case, an exhaust duct of a thermal power plant, or a fuel cell component such as a separator, an interconnector, or a reformer. No particular limitation is imposed on the method for welding these components, and the welding used may be ordinary arc welding such as MIG (Metal Inert Gas), MAG (Metal Active Gas), or TIG (Tungsten Inert Gas) welding, resistance welding such as spot welding or seam welding, high frequency resistance welding such as electric welding, or high frequency induction welding.

Examples

The present invention will next be described in more detail by way of Examples.

Steels having chemical compositions Nos. 1 to 56 shown in Table 1 were prepared in a vacuum melting furnace and casted into 30 kg steel ingots, and each steel ingot was forged and divided into two blocks. One of the two divided blocks of steel was heated to 1,170° C. and hot-rolled to obtain a hot-rolled sheet with a thickness of 5 mm. The hot-rolled sheet was annealed in a temperature range of 1,000 to 1,150° C. and then pickled to obtain an annealed hot-rolled sheet. Then the annealed hot-rolled sheet was cold-rolled at a rolling reduction of 60%, and the resulting sheet was subjected to finish annealing at a temperature of 1,000 to 1,150° C. and then pickled or polished to remove scale to thereby obtain an annealed cold-rolled sheet with a thickness of 2 mm. The annealed cold-rolled sheet was subjected to oxidation tests. For reference, SUS444 (No. 29) was used to produce an annealed cold-rolled sheet in the same manner as described above, and the annealed cold-rolled sheet was subjected to the oxidation tests. The annealing temperature for each steel was determined while the microstructure of the steel was observed after annealing within the above-described temperature range.

<Continuous Oxidation Test in Air>

A 30 mm×20 mm test piece was cut from each one of the annealed cold-rolled sheets obtained in the manner described above. A 4 mm ϕ hole was formed in an upper portion of the test piece, and its surfaces and edge surfaces were polished with a #320 emery paper. Then the test piece was degreased and then suspended in an air atmosphere inside a furnace heated to and retained at 1,100° C. Then the test piece was held inside the furnace for 200 hours. After the test, the mass of the test piece was measured, and the difference between this mass and the mass measured before the test was determined to thereby calculate the weight gain by oxidation (g/m$^2$). The test was performed twice to obtain two weight gains by oxidation, and the larger value was used for evaluation. The weight gain by oxidation includes the weight of spalled scale. The test result was evaluated as follows.

○: No breakaway oxidation and no spalling of scale occurred.

Δ: No breakaway oxidation occurred, but spalling of scale occurred.

x: Breakaway oxidation (weight gain by oxidation 50 g/m$^2$) occurred.

The results obtained are shown in Table 1. ○ indicates pass, and Δ and x indicate fail (see continuous oxidation at 1,100° C. in Table 1).

<Cyclic Oxidation Test in Air>

A 30 mm×20 mm test piece was cut from each one of the annealed cold-rolled sheets obtained in the manner described above. A 4 mm ϕ hole was formed in an upper portion of the test piece, and its surfaces and edge surfaces were polished with a #320 emery paper. Then the test piece was degreased, and the resulting test piece was subjected to 400 heat treatment cycles. In a heat treatment cycle, the test piece was held in air inside a furnace at 1,100° C. for 20 minutes and then held at 200° C. or lower for one minute. After the test, the mass of the test piece was measured, and the difference between this mass and the mass measured before the test was determined to thereby compute the weight gain by oxidation (g/m$^2$). Further, the presence or absence of spalling of oxide scale was visually checked. The test was performed twice to obtain two weight gains by oxidation, and the larger value was used for evaluation. Among the two test pieces, the test piece with more significant spalling was used for the evaluation.

○: No breakaway oxidation and no spalling of scale occurred.

Δ: No breakaway oxidation occurred, but spalling of scale occurred.

x: Breakaway oxidation (weight gain by oxidation 50 g/m$^2$) occurred.

The results obtained are shown in Table 1. ○ indicates pass, and Δ and x indicate fail (see cyclic oxidation at 1,100° C. in Table 1).

Next, the other one of the two blocks of steel prepared by dividing the 30 kg steel ingot each was used. Specifically, the block of steel was heated to 1,170° C. and hot-rolled into a sheet bar having a thickness of 35 mm×a width of 150 mm, and then the sheet bar was forged into a 30 mm-square rod. The rod was annealed at a temperature of 1,000 to 1,150° C. and then machined into a thermal fatigue test piece having the shape and dimensions shown in FIG. 1, and the thermal fatigue test piece was subjected to thermal expansion coefficient measurement and a thermal fatigue test described below. The annealing temperature was set to the temperature at which recrystallization was completed. The annealing temperature to be set was determined by checking the microstructure of each composition. For reference, a steel having the chemical composition of SUS444 was used to produce a test piece in the same manner as described above, and the test piece was subjected to the thermal expansion coefficient measurement and the thermal fatigue test.

<Measurement of Thermal Expansion Coefficient>

The thermal fatigue test pieces prepared above was used to measure the thermal expansion coefficient. The measurement was performed as follows. The test piece was heated and cooled between 200° C. and 950° C. while no load was applied, and this cycle was repeated three times. The amount of displacement at the third cycle during which the displacement was stabilized was read, and the thermal expansion coefficient was calculated and evaluated as follows.

○: less than $13.0\times10^{-6}$/° C.

x: $13.0\times10^{-6}$/° C. or more

The results obtained are shown in Table 1. ○ indicates pass, and x indicates fail (see thermal expansion at 950° C. in Table 1).

<Thermal Fatigue Test>

Figure 2:
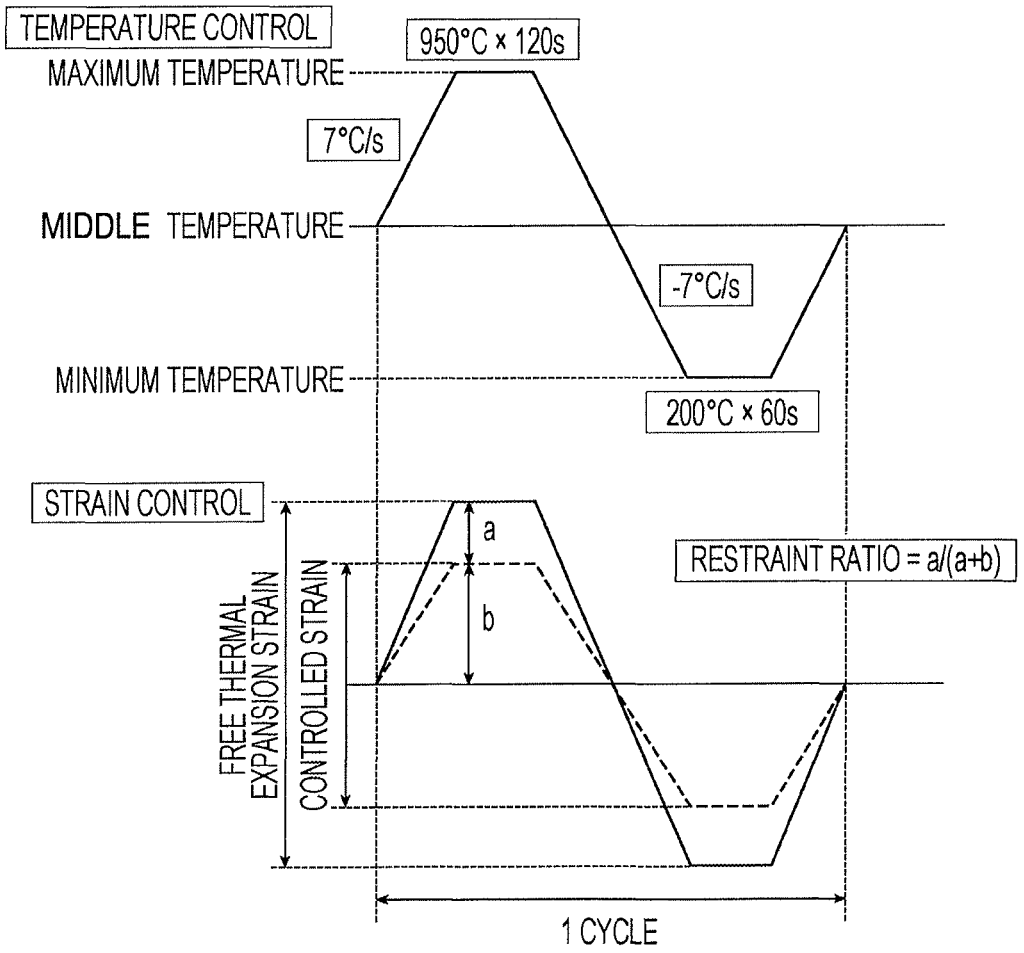
FIG. 2 is an illustration showing temperature and restraint condition's in the thermal fatigue test.

As shown in FIG. 2, the thermal fatigue test was performed under the conditions in which the test piece described above was repeatedly heated and cooled between 200° C. and 950° C. while the test piece was restrained at a restraint ratio of 0.5. In this case, the heating rate was 7° C./second, and the cooling rate was 7° C./second. The holding time at 200° C. was 1 minute, and the holding time at 950° C. was 2 minutes. As shown in FIG. 2, the restraint ratio mentioned above can be represented as $\eta=a/(a+b)$. Here, "a" means (free thermal expansion strain-controlled strain)/2, and "b" means controlled strain/2. The free thermal expansion strain is a strain when the test piece is heated with no mechanical stress applied thereto, and the controlled strain is the absolute value of the strain generated during the test. The substantial restrained strain generated in the material under the restrained conditions is (free thermal expansion strain—controlled strain).

The thermal fatigue life was evaluated as follows. The load detected at 200° C. was divided by the cross-sectional area of a uniform temperature parallel portion (see FIG. 1) of the test piece to calculate a stress. The number of cycles at which the value of the stress was reduced to 75% of the value of the stress in an initial period of cycles (at the fifth cycle at which the test was performed at a stabilized condition) was used as the thermal fatigue life, and the thermal fatigue life was evaluated as follows.

⊙: 1,200 cycles or more (pass)

○: 800 cycles or more and less than 1,200 cycles (pass)

x: less than 800 cycles (fail)

The results obtained are shown in Table 1. ⊙ and ○ indicate pass, and x indicates fail (see thermal fatigue life at 950° C. in Table 1).

TABLE 1

| Steel No. | Chemical composition (% by mass) C | Si | Mn | P | S | Al | N | Cr | Nb | Ti | Mo | Co | Ni | Others | Si + Al | Al − Mn | Nb − Ti | Oxidation resistance: Continuous oxidation at 1100° C. | Oxidation resistance: Cyclic oxidation at 1100° C. | Thermal fatigue resistance: Thermal expansion at 950° C. | Thermal fatigue resistance: Thermal fatigue life at 950° C. | Remarks |
|---|---|---|---|---|---|---|---|---|---|---|---|---|---|---|---|---|---|---|---|---|---|---|
| 1 | 0.007 | 0.83 | 0.11 | 0.033 | 0.002 | 3.04 | 0.009 | 18.5 | 0.51 | 0.22 | 1.8 | 0.04 | 0.15 | — | 3.87 | 2.93 | 0.29 | ○ | ○ | ○ | ⊙ | Inventive Example |
| 2 | 0.005 | 0.91 | 0.20 | 0.034 | 0.003 | 0.32 | 0.008 | 19.7 | 0.48 | 0.16 | 2.0 | 0.08 | 0.13 | — | 1.23 | 0.12 | 0.32 | ○ | ○ | ○ | ⊙ | Inventive Example |
| 3 | 0.004 | 0.18 | 0.44 | 0.034 | 0.001 | 3.63 | 0.008 | 18.2 | 0.46 | 0.20 | 3.1 | 0.08 | 0.03 | — | 3.81 | 3.19 | 0.26 | ○ | ○ | ○ | ⊙ | Inventive Example |
| 4 | 0.003 | 0.50 | 0.17 | 0.029 | 0.002 | 3.89 | 0.010 | 17.2 | 0.47 | 0.17 | 4.0 | 0.03 | 0.28 | — | 4.40 | 3.72 | 0.29 | ○ | ○ | ○ | ⊙ | Inventive Example |
| 5 | 0.006 | 0.65 | 0.13 | 0.035 | 0.002 | 1.18 | 0.007 | 19.2 | 0.44 | 0.23 | 3.8 | 0.04 | 0.28 | — | 1.83 | 1.05 | 0.21 | ○ | ○ | ○ | ⊙ | Inventive Example |
| 6 | 0.003 | 0.82 | 0.50 | 0.038 | 0.003 | 4.89 | 0.009 | 19.6 | 0.47 | 0.26 | 3.5 | 0.08 | 0.13 | — | 5.71 | 4.39 | 0.21 | ○ | ○ | ○ | ⊙ | Inventive Example |
| 7 | 0.006 | 0.77 | 0.36 | 0.020 | 0.002 | 3.24 | 0.010 | 16.4 | 0.43 | 0.18 | 3.8 | 0.05 | 0.48 | — | 4.01 | 2.88 | 0.25 | ○ | ○ | ○ | ⊙ | Inventive Example |
| 8 | 0.005 | 1.08 | 0.77 | 0.028 | 0.002 | 4.21 | 0.011 | 13.7 | 0.54 | 0.13 | 2.3 | 0.06 | 0.24 | — | 5.29 | 3.44 | 0.41 | ○ | ○ | ○ | ⊙ | Inventive Example |
| 9 | 0.007 | 0.83 | 0.17 | 0.020 | 0.003 | 3.90 | 0.009 | 25.1 | 0.41 | 0.24 | 2.6 | 0.03 | 0.08 | — | 4.73 | 3.73 | 0.17 | ○ | ○ | ○ | ⊙ | Inventive Example |
| 10 | 0.003 | 1.08 | 0.40 | 0.025 | 0.002 | 2.81 | 0.005 | 17.3 | 0.38 | 0.17 | 1.2 | 0.04 | 0.13 | — | 3.89 | 2.40 | 0.21 | ○ | ○ | ○ | ⊙ | Inventive Example |
| 11 | 0.005 | 0.96 | 0.57 | 0.021 | 0.002 | 2.83 | 0.007 | 16.6 | 0.82 | 0.11 | 3.8 | 0.04 | 0.14 | — | 3.79 | 2.26 | 0.71 | ○ | ○ | ○ | ⊙ | Inventive Example |
| 12 | 0.004 | 1.07 | 0.23 | 0.027 | 0.002 | 2.99 | 0.008 | 19.4 | 0.54 | 0.05 | 3.0 | 0.02 | 0.29 | — | 4.06 | 2.77 | 0.49 | ○ | ○ | ○ | ⊙ | Inventive Example |
| 13 | 0.007 | 1.03 | 0.31 | 0.022 | 0.003 | 3.02 | 0.008 | 19.2 | 0.54 | 0.44 | 2.3 | 0.03 | 0.03 | — | 4.04 | 2.70 | 0.10 | ○ | ○ | ○ | ⊙ | Inventive Example |
| 14 | 0.005 | 0.75 | 0.26 | 0.036 | 0.001 | 2.25 | 0.008 | 18.1 | 0.41 | 0.15 | 0.4 | 0.04 | 0.17 | — | 3.00 | 1.99 | 0.26 | ○ | ○ | ○ | ⊙ | Inventive Example |
| 15 | 0.004 | 0.62 | 0.79 | 0.023 | 0.002 | 2.70 | 0.006 | 16.9 | 0.42 | 0.20 | 5.2 | 0.06 | 0.18 | — | 3.32 | 1.91 | 0.22 | ○ | ○ | ○ | ⊙ | Inventive Example |
| 16 | 0.005 | 0.72 | 0.19 | 0.037 | 0.001 | 2.27 | 0.009 | 16.8 | 0.46 | 0.11 | 3.7 | 0.20 | 0.14 | — | 2.99 | 2.09 | 0.35 | ○ | ○ | ○ | ⊙ | Inventive Example |
| 17 | 0.003 | 0.60 | 0.20 | 0.035 | 0.002 | 2.70 | 0.006 | 18.8 | 0.51 | 0.17 | 3.4 | 2.83 | 0.07 | — | 3.30 | 2.50 | 0.34 | ○ | ○ | ○ | ⊙ | Inventive Example |
| 18 | 0.007 | 2.21 | 0.38 | 0.031 | 0.001 | 3.48 | 0.006 | 17.8 | 0.47 | 0.11 | 1.7 | 0.04 | 0.28 | — | 5.69 | 3.10 | 0.37 | ○ | ○ | ○ | ⊙ | Inventive Example |
| 19 | 0.004 | 1.03 | 1.53 | 0.025 | 0.002 | 2.77 | 0.011 | 16.9 | 0.45 | 0.23 | 3.8 | 0.03 | 0.08 | — | 3.80 | 1.24 | 0.22 | ○ | ○ | ○ | ⊙ | Inventive Example |
| 20 | 0.003 | 0.83 | 0.65 | 0.033 | 0.001 | 2.21 | 0.006 | 19.5 | 0.53 | 0.25 | 3.2 | 0.02 | 0.19 | W: 0.39 | 3.04 | 1.56 | 0.28 | ○ | ○ | ○ | ⊙ | Inventive Example |
| 21 | 0.007 | 1.22 | 0.16 | 0.020 | 0.003 | 2.91 | 0.006 | 18.3 | 0.53 | 0.15 | 1.6 | 0.07 | 0.12 | W: 3.03 | 4.13 | 2.75 | 0.39 | ○ | ○ | ○ | ⊙ | Inventive Example |
| 22 | 0.007 | 0.51 | 0.18 | 0.032 | 0.001 | 2.61 | 0.007 | 17.4 | 0.47 | 0.29 | 1.4 | 0.04 | 0.25 | V: 0.04 | 3.12 | 2.43 | 0.18 | ○ | ○ | ○ | ⊙ | Inventive Example |
| 23 | 0.007 | 1.20 | 0.69 | 0.026 | 0.002 | 2.65 | 0.008 | 17.2 | 0.55 | 0.28 | 3.6 | 0.04 | 0.19 | V: 0.26 | 3.85 | 1.95 | 0.27 | ○ | ○ | ○ | ⊙ | Inventive Example |
| 24 | 0.004 | 0.84 | 0.50 | 0.026 | 0.003 | 2.74 | 0.010 | 18.7 | 0.46 | 0.21 | 1.8 | 0.09 | 0.29 | Zr: 0.08 | 3.58 | 2.24 | 0.25 | ○ | ○ | ○ | ⊙ | Inventive Example |
| 25 | 0.005 | 0.95 | 0.24 | 0.029 | 0.002 | 3.28 | 0.010 | 18.0 | 0.45 | 0.29 | 1.3 | 0.04 | 0.11 | B: 0.0008 | 4.24 | 3.04 | 0.15 | ○ | ○ | ○ | ⊙ | Inventive Example |
| 26 | 0.004 | 0.77 | 0.74 | 0.037 | 0.002 | 3.46 | 0.011 | 18.7 | 0.44 | 0.19 | 2.7 | 0.09 | 0.30 | Ca: 0.0007 | 4.24 | 2.72 | 0.25 | ○ | ○ | ○ | ⊙ | Inventive Example |
| 27 | 0.007 | 0.88 | 0.78 | 0.039 | 0.002 | 3.69 | 0.008 | 18.3 | 0.48 | 0.11 | 3.0 | 0.05 | 0.17 | Mg: 0.0010 | 4.57 | 2.91 | 0.37 | ○ | ○ | ○ | ⊙ | Inventive Example |
| 28 | 0.004 | 0.97 | 0.30 | 0.024 | 0.001 | 3.17 | 0.010 | 17.7 | 0.52 | 0.14 | 2.5 | 0.02 | 0.18 | Ca: 0.0009, Mg: 0.0007 | 4.14 | 2.87 | 0.38 | ○ | ○ | ○ | ⊙ | Inventive Example |
| 39 | 0.004 | 0.65 | 1.03 | 0.031 | 0.002 | 3.11 | 0.008 | 18.4 | 0.36 | 0.27 | 1.9 | 0.08 | 0.40 | Cu: 0.24, Ca: 0.0008 | 3.76 | 2.08 | 0.09 | ○ | ○ | ○ | ○ | Inventive Example |
| 40 | 0.005 | 0.93 | 0.15 | 0.029 | 0.001 | 2.89 | 0.010 | 20.6 | 0.48 | 0.19 | 1.6 | 0.05 | 0.21 | Cu: 0.26 | 3.82 | 2.74 | 0.29 | ○ | ○ | ○ | ○ | Inventive Example |
| 41 | 0.005 | 1.88 | 0.50 | 0.030 | 0.002 | 1.23 | 0.009 | 19.9 | 0.54 | 0.20 | 2.4 | 0.29 | 0.78 | — | 3.11 | 0.73 | 0.34 | ○ | ○ | ○ | ⊙ | Inventive Example |
| 42 | 0.007 | 1.56 | 0.24 | 0.027 | 0.002 | 1.89 | 0.007 | 21.4 | 0.50 | 0.14 | 2.9 | 0.10 | 0.19 | — | 3.45 | 1.65 | 0.36 | ○ | ○ | ○ | ⊙ | Inventive Example |
| 43 | 0.004 | 0.58 | 0.77 | 0.028 | 0.002 | 2.13 | 0.011 | 18.9 | 0.37 | 0.19 | 0.8 | 0.47 | 0.29 | — | 2.71 | 1.36 | 0.18 | ○ | ○ | ○ | ⊙ | Inventive Example |
| 44 | 0.006 | 0.34 | 0.49 | 0.030 | 0.001 | 3.28 | 0.009 | 20.0 | 0.42 | 0.31 | 1.2 | 1.03 | 0.17 | — | 3.62 | 2.79 | 0.11 | ○ | ○ | ○ | ⊙ | Inventive Example |
| 45 | 0.005 | 0.53 | 0.18 | 0.031 | 0.003 | 2.47 | 0.008 | 20.7 | 0.45 | 0.26 | 2.0 | 1.97 | 0.15 | — | 3.00 | 2.29 | 0.19 | ○ | ○ | ○ | ⊙ | Inventive Example |
| 46 | 0.006 | 0.67 | 0.13 | 0.029 | 0.003 | 5.68 | 0.007 | 19.7 | 0.43 | 0.18 | 1.7 | 0.06 | 0.16 | — | 6.35 | 5.55 | 0.25 | ○ | ○ | ○ | ⊙ | Inventive Example |
| 47 | 0.005 | 0.78 | 0.30 | 0.030 | 0.002 | 2.56 | 0.010 | 20.3 | 0.42 | 0.15 | 2.2 | 0.04 | 0.27 | Cu: 0.06 | 3.34 | 2.26 | 1.46 | ○ | ○ | ○ | ○ | Inventive Example |
| 48 | 0.006 | 0.69 | 0.18 | 0.028 | 0.001 | 3.24 | 0.006 | 18.5 | 0.50 | 0.19 | 1.9 | 0.16 | 0.11 | V: 0.19, Ca: 0.0010 | 3.93 | 3.06 | 2.46 | ○ | ○ | ○ | ⊙ | Inventive Example |
| 29 | 0.006 | 0.28 | 0.19 | 0.023 | 0.003 | 0.02 | 0.008 | 18.2 | 0.37 | — | 1.80 | — | 0.14 | B: 0.0001 | 0.30 | −0.17 | 0.37 | Δ | Δ | ○ | X | Conventional Example |

TABLE 1-continued

| Steel No. | Chemical composition (% by mass) C | Si | Mn | P | S | Al | N | Cr | Nb | Ti | Mo | Co | Ni | Others | Si + Al | Al − Mn | Nb − Ti | Oxidation resistance: Continuous oxidation at 1100° C. | Oxidation resistance: Cyclic oxidation at 1100° C. | Thermal fatigue resistance: Thermal expansion at 950° C. | Thermal fatigue resistance: Thermal fatigue life at 950° C. | Remarks |
|---|---|---|---|---|---|---|---|---|---|---|---|---|---|---|---|---|---|---|---|---|---|---|
| | | | | | | | | | | | | | | | | | | | | | | SUS444 |
| 30 | 0.004 | 0.85 | 0.29 | 0.022 | 0.002 | 3.86 | 0.008 | 18.8 | 0.24 | 0.18 | 1.8 | 0.02 | 0.15 | — | 4.71 | 3.57 | 0.06 | ○ | ○ | ○ | X | Comparative Example |
| 31 | 0.005 | 1.20 | 0.63 | 0.025 | 0.003 | 2.98 | 0.006 | 10.7 | 0.54 | 0.20 | 1.8 | 0.04 | 0.23 | — | 4.18 | 2.35 | 0.33 | X | X | ○ | X | Comparative Example |
| 32 | 0.006 | 1.03 | 0.54 | 0.028 | 0.003 | 0.21 | 0.011 | 17.1 | 0.53 | 0.10 | 1.2 | 0.06 | 0.27 | — | 1.24 | −0.33 | 0.43 | X | X | ○ | X | Comparative Example |
| 33 | 0.004 | 0.97 | 0.11 | 0.034 | 0.002 | 2.20 | 0.007 | 16.2 | 0.41 | 0.29 | 3.8 | — | 0.18 | — | 3.17 | 2.09 | 0.12 | ○ | ○ | X | X | Comparative Example |
| 34 | 0.006 | 1.01 | 0.77 | 0.031 | 0.002 | 2.21 | 0.005 | 18.1 | 0.44 | 0.22 | 0.2 | 0.03 | 0.20 | — | 3.22 | 1.45 | 0.23 | ○ | ○ | ○ | X | Comparative Example |
| 35 | 0.005 | 1.09 | 0.17 | 0.035 | 0.002 | 3.33 | 0.010 | 16.0 | 0.42 | 0.14 | 2.1 | 0.02 | 0.01 | — | 4.42 | 3.17 | 0.28 | X | X | ○ | X | Comparative Example |
| 36 | 0.005 | 0.07 | 0.55 | 0.030 | 0.002 | 3.46 | 0.009 | 19.5 | 0.44 | 0.20 | 1.3 | 0.05 | 0.22 | — | 3.53 | 2.91 | 0.24 | X | X | ○ | X | Comparative Example |
| 37 | 0.005 | 0.70 | 0.03 | 0.027 | 0.001 | 3.78 | 0.009 | 17.9 | 0.45 | 0.22 | 3.1 | 0.01 | 0.06 | — | 4.48 | 3.75 | 0.23 | ○ | X | ○ | X | Comparative Example |
| 38 | 0.003 | 0.37 | 0.21 | 0.034 | 0.002 | 0.55 | 0.011 | 19.2 | 0.49 | 0.28 | 2.7 | 0.02 | 0.16 | — | 0.92 | 0.34 | 0.21 | X | X | ○ | X | Comparative Example |
| 49 | 0.005 | 0.69 | 1.33 | 0.029 | 0.002 | 1.05 | 0.010 | 18.7 | 0.48 | 0.19 | 1.8 | 0.04 | 0.20 | — | 1.74 | −0.28 | 0.29 | X | X | ○ | ○ | Comparative Example |
| 50 | 0.006 | 1.11 | 0.35 | 0.031 | 0.002 | 2.56 | 0.008 | 19.3 | 0.51 | 0.15 | 6.7 | 0.10 | 0.31 | — | 3.67 | 2.21 | 0.36 | ○ | ○ | ○ | X | Comparative Example |
| 51 | 0.005 | 0.90 | 0.44 | 0.031 | 0.001 | 1.59 | 0.007 | 20.1 | 0.46 | 0.22 | 2.3 | 0.06 | 1.21 | — | 2.49 | 1.15 | 0.24 | X | X | X | X | Comparative Example |
| 52 | 0.004 | 0.86 | 0.29 | 0.028 | 0.002 | 2.64 | 0.009 | 18.8 | 0.41 | 0.44 | 3.0 | 0.08 | 0.23 | — | 3.50 | 2.35 | −0.03 | ○ | ○ | ○ | X | Comparative Example |
| 53 | 0.007 | 0.54 | 0.24 | 0.033 | 0.003 | 2.89 | 0.011 | 19.0 | 0.37 | 0.41 | 1.7 | 0.07 | 0.24 | — | 3.43 | 2.65 | −0.04 | ○ | ○ | ○ | X | Comparative Example |
| 54 | 0.006 | 1.03 | 0.30 | 0.034 | 0.002 | 2.06 | 0.009 | 19.5 | 0.46 | 0.18 | 2.2 | 0.13 | 0.17 | Cu: 0.55 | 3.09 | 1.76 | 0.28 | ○ | X | ○ | X | Comparative Example |
| 55 | 0.004 | 1.11 | 0.15 | 0.030 | 0.002 | 0.19 | 0.010 | 18.9 | 0.48 | 0.20 | 1.9 | 0.11 | 0.24 | — | 1.30 | 0.04 | 0.28 | ○ | ○ | ○ | ○ | Comparative Example |
| 56 | 0.007 | 0.89 | 0.25 | 0.031 | 0.002 | 3.33 | 0.009 | 18.8 | 0.46 | — | 2.3 | 0.14 | 0.21 | — | 4.22 | 3.08 | 0.46 | X | X | ○ | X | Comparative Example |

Note:
Underlined values are outside the scope of the invention.
The balance other than the above compositional elements is Fe and unavoidable impurities.

As can be seen from Table 1, in steels Nos. 1 to 28 and 39 to 48 in Inventive Examples, no breakaway oxidation and no spalling of oxide scale occurred in the two oxidation tests, and their thermal fatigue life was much better than that of SUS444 (steel No. 29).

In steel No. 30, the Nb content is 0.3% by mass or less, and the thermal fatigue resistance is evaluated as fail. In steel No. 31, the Cr content is less than 12% by mass. Therefore, in these steels the oxidation resistances is evaluated as fail, and along with that the thermal fatigue life is evaluated as fail.

In steel No. 32, the Al content is less than 0.3% by mass, and the value of Al—Mn is less than 0% by mass. Therefore, not only the oxidation resistances are evaluated as fail, but also the thermal fatigue life is evaluated as fail. In steel No. 33, Co is not contained, and thus the Co content is less than 0.01% by mass. Therefore, the thermal expansion coefficient is large, and owing thereto the thermal fatigue life is evaluated as fail.

In steel No. 34, the Mo content is less than 0.3% by mass, and the thermal fatigue life is evaluated as fail. In steel No. 35, the Ni content is less than 0.02% by mass, and the oxidation resistance is evaluated as fail. Along with that, the thermal fatigue life is evaluated as fail.

In steel No. 36, the Si content is 0.1% by mass or less, and the oxidation resistance is evaluated as fail. Along with that, the thermal fatigue life is evaluated as fail. In steel No. 37, the Mn content is less than 0.05% by mass, and the cyclic oxidation resistance is evaluated as fail. The thermal fatigue life is also evaluated as fail.

In steel No. 38, the value of Si+Al is 1.0% by mass or less. The oxidation resistance is evaluated as fail, and the thermal fatigue life is also rated fail. In steel No. 49, Al—Mn is 0% by mass or less, and the oxidation resistance is evaluated as fail.

In steel No. 50, the Mo content exceeds 6.0% by mass, and the thermal fatigue resistance is evaluated as fail. In steel No. 51, the Ni content exceeds 1.0% by mass, and the oxidation resistance and also the thermal fatigue resistance are evaluated as fail.

In steel No. 52 and steel No. 53, Nb—Ti is 0% by mass or less, and the thermal fatigue resistance is evaluated as fail. In steel No. 54, the Cu content exceeds 0.30% by mass, and the cyclic oxidation resistance is evaluated as fail.

In steel No. 55, the Al content is less than 0.3%, and the thermal fatigue resistance is evaluated as fail. In steel No. 56, the Ti content is less than 0.01%, and the continuous oxidation and also the cyclic oxidation are evaluated as fail. Along with that, the thermal fatigue resistance is evaluated as fail.

INDUSTRIAL APPLICABILITY

The ferritic stainless steel according to aspects of the present invention is not only suitable for exhaust components of automobiles etc. but also suitable for exhaust components of thermal power generation systems and components of solid oxide fuel cells that require similar characteristics.

The invention claimed is:

1. A ferritic stainless steel having a composition consisting of, in mass %, C: 0.020% or less, Si: more than 0.1% and 3.0% or less, Mn: 0.05 to 2.0%, P: 0.050% or less, S: 0.010% or less, Al: more than 2.0% to 6.0% or less, N: 0.020% or less, Cr: 14.0% to 30%, Nb: more than 0.3% and 1.0% or less, Ti: 0.01 to 0.5%, Mo: 0.3 to 6.0%, Co: 0.01 to 3.0%, Ni: 0.02 to 1.0%, and optionally one or two or more selected from B: 0.0002 to 0.0050%, Zr: 0.005 to 1.0%, V: 0.01 to 1.0%, W: 0.01 to 0.39%, Ca: 0.0002 to 0.0050% and Mg: 0.0002 to 0.0050%, with the balance being Fe and unavoidable impurities, wherein the ferritic stainless steel satisfies the following formulas (1) to (3):

$$Si+Al>2.0\% \quad (1)$$

$$Al—Mn>0\% \quad (2)$$

$$Nb—Ti>0\% \quad (3),$$

where the Si, Al, Mn, Nb, and Ti in the formulas (1) to (3) represent the contents, in mass %, of the respective elements.

* * * * *